United States Patent [19]

Davis

[11] 4,106,468

[45] Aug. 15, 1978

[54] PRESSURE RATIO VALVE

[75] Inventor: Bill G. Davis, Phoenix, Ariz.

[73] Assignee: Jetco, Inc., Phoenix, Ariz.

[21] Appl. No.: 778,852

[22] Filed: Mar. 18, 1977

[51] Int. Cl.[2] ..... F01M 1/00

[52] U.S. Cl. ..... 123/196 S; 123/198 D; 123/198 DB; 123/198 DC; 184/6.4

[58] Field of Search ..... 123/196 S, 198 D, 198 DB, 123/198 DC; 184/6.4, 6.5

[56] References Cited

U.S. PATENT DOCUMENTS

| | | | |
|---|---|---|---|
| 1,746,628 | 2/1930 | Barnes | 123/196 S |
| 3,590,798 | 7/1971 | Goodwin | 123/198 D |

*Primary Examiner*—Ronald H. Lazarus

*Attorney, Agent, or Firm*—Cahill, Sutton & Thomas

[57] ABSTRACT

A pressure ratio valve is installed in an internal combustion engine having a pressurized air supply and an air actuatable throttle control means for limiting the engine RPM in response to a pneumatic control signal. The pressure ratio valve continuously senses both the engine oil pressure and the pressure of the engine compressed air system and generates the pneumatic control signal in response thereto. When the oil pressure-air pressure ratio decreases below a predetermined magnitude, an unsafe engine oil pressure condition is indicated and the pressure ratio valve generates a pneumatic control signal which causes the throttle control means to limit the engine RPM to a safe level.

10 Claims, 3 Drawing Figures

PRESSURE RATIO VALVE

BACKGROUND OF THE INVENTION

1. Field of the Invention

This invention relates to valves, and more particularly, to pressure ratio valves for generating a pneumatic control signal for controlling an air actuatable throttle control means in response to the ratio of the pressures of a fluid and a high pressure air supply.

2. Description of the Prior Art

In the operation of internal combustion engines it is frequently desirable to provide throttle control means for automatically limiting the engine RPM when certain conditions occur which would be detrimental to the engine. To provide such protection, throttle control means such as an air actuatable throttle control cylinder have been designed to forcefully and automatically reduce the engine RPM to a predetermined value, such as idle RPM, in response to a change in a pneumatic control signal. A separate pressure ratio valve senses the pressure ratio between the vehicle's oil pressure and its compressed air system pressure. The combination of the throttle control cylinder and the pressure ratio valve prevents the occurrence of high engine RPMs during starting before the engine oil system has attained its normal operating pressure. The system also automatically and forcefully reduces the engine RPM to a predetermined level whenever the engine oil pressure-air pressure ratio decreases below a predetermined value. This latter event would occur if the oil pressure system became obstructed or an oil line ruptured causing a dangerously low oil pressure.

One prior art pressure ratio valve which accomplishes the above-mentioned objectives is manufactured by Sentinel Distributors, Inc., and is structurally identical to the fuel shut-off device disclosed in U.S. Pat. No. 3,523,521. This apparatus is exceedingly sophisticated, complex, and expensive. It utilizes a pressure sensing piston in combination with a ball and seat valve and a pair of biasing springs to bias the ball and seat valve and the piston into predetermined positions. The ball and seat valve is extremely susceptible to damage from foreign particulate matter circulated within the compressed air system of a vehicle. The Sentinel device also includes a dial-operated, cam driven override assembly disposed in the lower portion thereof to open the ball and seat valve in order to permit engine operation under certain conditions. The Sentinel device is extremely difficult to manufacture and assemble since four radially inwardly extending annular seats must be fabricated within its longitudinally extending bore to provide proper seating and support for the various internal elements. Furthermore, the Sentinel device requires two removable end caps so that the various internal components can be inserted from both ends during assembly. As installed in an internal combustion engine system, the Sentinel device requires a special vented valve assembly in series with a quick release valve between the control port and the input to the throttle control cylinder. The installation of this device is thereby greatly complicated and overall system reliability is thereby decreased.

SUMMARY OF THE INVENTION

It is therefore a primary object of the present invention to provide a pressure ratio valve which will actuate a throttle control means to prevent engine operation above a predetermined safe RPM when the pressure ratio valve senses an oil pressure-fuel pressure ratio less than a predetermined magnitude.

Another object of the present invention is to provide a pressure ratio valve which is readily installed in an existing engine.

Yet another object of the present invention is to provide a pressure ratio valve which has a single moving part.

Still another object of the present invention is to provide a pressure ratio valve which has a near zero failure rate and which is virtually immune to foreign object damage.

A still further object of the present invention is to provide a pressure ratio valve the output of which can be directly connected to the input of a throttle control cylinder.

A yet further object of the present invention is to provide a pressure ratio valve which is extremely resistant to damage resulting from vibration and shock.

Briefly stated, and in accord with one embodiment of the invention, an internal combustion engine includes a pressurized air supply and an air actuatable throttle control means for limiting the engine RPM in response to a pneumatic control signal. A pressure ratio valve compares the engine oil pressure with the pressure of the air supply and generates the pneumatic control signal in response thereto. The valve includes a body having a cylindrical bore and a radially inwardly extending annular seat which divides the bore into first and second sections. An oil pressure port is connected to an engine oil pressure line having a predetermined normal operating pressure. The oil pressure port communicates with the first bore section. An air pressure port is connected to the pressurized air supply and communicates with the second bore section. A control port also communicates with the second bore section and transmits the pneumatic control signal from the valve to the throttle control means. An exhaust port communicates with the first bore section.

A piston is slidably displaceable in the bore between a first position and a second position. The piston includes a first pressure receiving head which receives oil under pressure from the oil pressure port. A second pressure receiving head is located on the opposite end of the piston and is slidably displaceable within the second bore section for opening a path between the air pressure port and the control port when the piston is in the second position. The second pressure receiving head blocks the path between the air pressure port and the control port when the piston is in the first position. A third pressure receiving head is positioned between the first and the second pressure receiving heads for permitting air to flow from the control port to the exhaust port when the piston is in the first position. The third pressure receiving head prevents air flow between the control port and the exhaust port when the piston is in the second position.

As a result of the above-mentioned interactions, the piston is urged into the first position when the air pressure-fluid pressure ratio decreases below a predetermined magnitude and actuates the throttle control means to limit the engine RPM.

DESCRIPTION OF THE DRAWING

The invention is pointed out with particularity in the appended claims. However, other objects and advantages, together with the operation of the invention, may be better understood by reference to the following detailed description taken in conjunction with the following illustrations wherein:

DESCRIPTION OF THE PREFERRED EMBODIMENT

In order to better illustrate the advantages of the invention and its contributions to the art, a preferred hardware embodiment of the invention will now be described in some detail.

Figure 1:
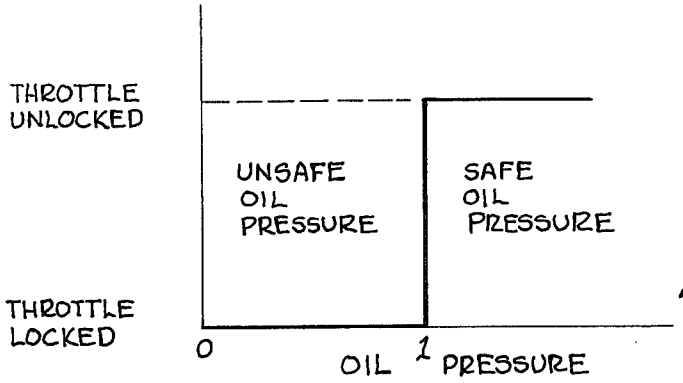
FIG. 1 is a graph illustrating the operational characteristics of an engine protection system incorporating a pressure ratio valve of the present invention.

The general operating characteristics of the invention will be described first by reference to the graph shown in FIG. 1. The X-axis of the graph represents the magnitude of the engine oil pressure while the Y-axis indicates the condition of the throttle control means or throttle control valve. When the engine oil pressure is within the range between zero and the oil pressure indicated by reference numeral 1, the pressure ratio valve will be maintained in a first position which transmits a pneumatic control signal to the throttle control cylinder causing the throttle control cylinder to be maintained in a predetermined locked position and preventing engine operation above a predetermined level, such as idle. Any time the oil pressure is at a level below the level indicated by reference numeral 1, engine operation above a low RPM could substantially damage the engine; for this reason this oil pressure region is defined as the unsafe oil pressure region. Whenever engine oil pressure is in the unsafe region, the pressure ratio valve of the present invention generates a pneumatic control signal which is transmitted to the throttle control cylinder which locks the engine throttle in a position to maintain the engine RPM at or below a desired RPM.

Once the engine oil pressure exceeds the level indicated by reference numeral 1, the engine oil pressure is within a safe region and the pressure ratio valve will generate a pneumatic control signal which is transmitted to the throttle control cylinder which will unlock the throttle and allow the engine to be operated at any desired RPM.

Figure 2:
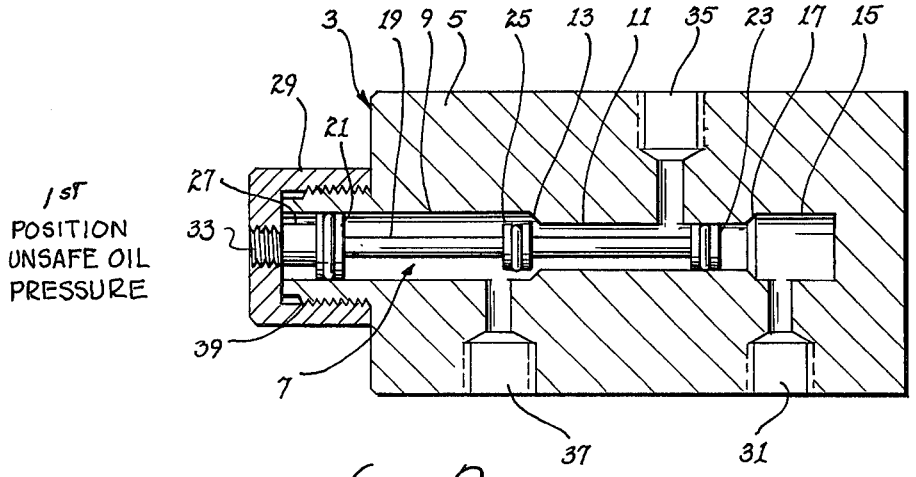
FIG. 2 is a sectional view of the pressure ratio valve of the present invention in a first position, indicative of an unsafe oil pressure.

Referring now to FIG. 2, pressure ratio valve 3 is shown in the first position which corresponds to an unsafe oil pressure. Valve 3 includes a body 5 having a cylindrical bore 7 which is divided into first bore section 9 and second bore section 11 by a tapered bore section 13. Second bore section 11 is further divided into a third bore section 15 by an additional tapered bore section 17.

Piston 19 is positioned within cylindrical bore 7 and is longitudinally displaceable therein. Piston 19 includes first pressure receiving head 21, second pressure receiving head 23 and third pressure receiving head 25. Piston extension 27 extends outward from first pressure receiving head 21 to prevent further leftward movement of piston 19 beyond the position shown in FIG. 2. End cap 29 is attached to a projection on one end body 5 to seal the open end of cylindrical bore 7.

A source of compressed air from a vehicle's compressed air system is coupled to air pressure port 31 which communicates with third bore section 15. A high pressure engine oil line is connected to oil pressure port 33 which transmits the engine oil pressure to first pressure receiving head 21 of piston 19. Control port 35 communicates with second bore section 11 and an air hose is coupled between the input port of a throttle control cylinder and control port 35 to transmit the pneumatic control signal from control port 35 to the throttle control cylinder. Throttle control cylinders are well known and comercially available. Upon receiving a supply of high pressure air, the throttle control cylinder which is coupled to the throttle linkage of an engine allows the linkage to move freely. When the input air pressure received by the throttle control cylinder falls to air ambient level, the throttle control cylinder prevents engine operation above an idle RPM by returning the engine throttle linkage to the idle position. Exhaust port 37 is maintained at normal atmospheric pressure and serves to vent any pressure greater than atmospheric pressure existing within the area of first bore section 9 located to the right of first pressure receiving head 21.

O-ring 39 is placed around the outer periphery of first pressure receiving head 21 to prevent the oil received through oil pressure port 33 from leaking to the other side of first pressure receiving head 21. Similarly, O-rings 41 and 43 are positioned around the outer periphery of second and third pressure receiving heads 23 and 25.

The operation of pressure ratio valve 3 will now be described. FIG. 2 shows pressure ratio valve 3 in a first position corresponding to an unsafe oil pressure which will cause the throttle control cylinder to lock the throttle in a low RPM state. Since the compressed air system in large trucks is almost always maintained at a constant level even when the engine is not operating, high pressure air will always be available and will be conducted through air pressure port 31 into third bore section 15. The high pressure air within this bore section will exert a force on second pressure receiving head 23 causing piston 19 to be displaced to its left-most position, as indicated in FIG. 2. As the oil pressure coupled to oil pressure port 33 is at an unsafe low or zero level, the piston 19 will remain in the left-most position.

In the position shown in FIG. 2, third pressure receiving head 25 will not be in contact with second bore section 11 so that a direct path will be opened between exhaust port 37 and control port 35. This will maintain the air pressure transmitted from control port 35 to the input port of the throttle control cylinder at normal atmospheric pressure which will maintain the throttle control cylinder in a locked position. Since the compressed air system of the vehicle to which the pressure ratio valve is attached will always provide high pressure air at air pressure port 31, piston 19 will be maintained in the position shown in FIG. 2 until oil pressure port 33 rises above a predetermined pressure.

Figure 3:
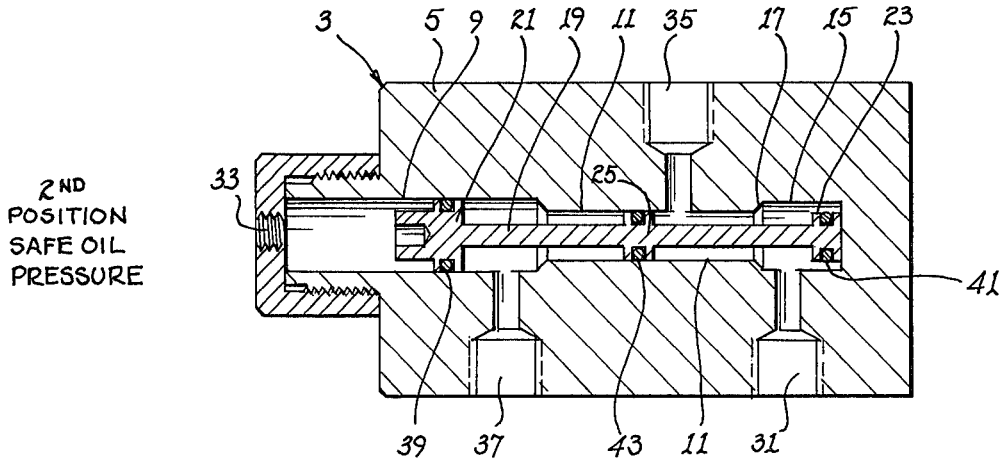
FIG. 3 is a sectional view of the pressure ratio valve of FIG. 2 in the second position, indicative of a safe oil pressure.

Referring now to FIG. 3, pressure ratio valve 3 is shown in the second position which indicates the presence of a safe oil pressure at oil pressure port 33. In this position the force produced on the left side of first pressure receiving head 21 exceeds the force produced on the right side of second pressure receiving head 23, causing piston 19 to be displaced to the right until second pressure receiving head 23 contacts the end of cylindrical bore 7. In this second position a path is created between air pressure port 31 and control port 35 which causes the pressurized air at air pressure port 31 to be coupled through control port 35 to the inlet port of the throttle control cylinder. In the second position exhaust port 37 is inactive. The presence of high pressure air at the inlet port of the throttle control cylinder causes the throttle control cylinder to unlock, permitting normal engine operation at any desired RPM.

The threshold oil pressure level at which piston 19 of pressure ratio valve 3 transitions from the first position to the second position can be altered by changing the relative diameters of first bore section 9 and second bore section 11. The diameter of third bore section 15 was increased slightly beyond the diameter of second bore section 11 to permit the overall length of cylindrical bore 7 to be minimized without changing the distance between ports 31 and 37. Pressure ratio valve 3 will function exactly as described if bore sections 11 and 15 are of identical diameters, however cylindrical bore 7 would have to be lengthened.

In the embodiment shown piston extension 27 was included to prevent further leftward motion of piston 19 from the position indicated in FIG. 2. Alternatively, extension 27 could be omitted and the length of piston 19 residing between first pressure receiving head 21 and third pressure receiving head 25 could be increased to perform an equivalent function.

It would be possible to use pressure ratio valve 3 in conjunction with a high pressure water pump as might be used on a fire engine to pump large volumes of water through fire hoses. For this type of service port 33 would be connected to the water output port of the water pump and would sense the pressure of the water at that location. Thus, when the source of water was exhausted, the water pressure at port 33 would drop to zero and pressure ratio valve 3 would transition to the first position or unsafe position. The throttle control valve on the internal combustion engine which powers the water pump would then position the engine throttle in the idle position to prevent overheating and eventual burnout of the water pump which had lost its source of water.

It will be apparent to those skilled in the art that the disclosed pressure ratio valve may be modified in numerous ways and may assume many embodiments other than the preferred forms specifically set out and described above. Accordingly, it is intended by the appended claims to cover all such modifications of the invention which fall within the true spirit and scope of the invention.

What is claimed is:

1. In an internal combustion engine having a pressurized air supply and an air actuatable throttle control means for controlling the engine RPM in response to a pneumatic control signal, a pressure ratio valve for comparing the pressures of an engine fluid having a predetermined normal operating pressure and the air supply and for generating the pneumatic control signal in response thereto, said valve comprising in combination:

a. a body having a cylindrical bore including first and second bore sections;

b. a fluid pressure port communicating with said first bore section for connection to the engine fluid having a predetermined normal operating pressure;

c. an air pressure port communicating with said second bore section for connection to the pressurized air supply;

d. a control port communicating with said second bore section for transmitting the pneumatic control signal from said valve to the throttle control means;

e. an exhaust port communicating with said first bore section;

f. a piston slidably positioned in said bore between a first position and a second position, said piston including 1. a first pressure receiving head on one end of said piston, positioned in said first bore section for receiving pressure from said engine fluid;

2. a second pressure receiving head, on the opposite end of said piston, positioned in said second bore section for receiving pressure from said air supply, said second pressure receiving head opening a path between said air pressure port and said control port when said piston is in the second position and for closing the path between said air pressure port and said control port when said piston is in the first position; and 3. a third pressure receiving head positioned intermediate said first and second pressure receiving heads for permitting air to flow from said control port to said exhaust port when said piston is in the first position and for preventing air flow between said control port and said exhaust port when said piston is in the second position;

whereby said piston is urged into the first position when the fluid pressure-air pressure ratio decreases below a predetermined magnitude for actuating the throttle control means to control the engine RPM.

2. The apparatus of claim 1 wherein said second bore section includes a third bore section.

3. The apparatus of claim 2 wherein said fluid is oil maintained under pressure within the engine.

4. The apparatus of claim 2 wherein said fluid is water being exhausted under pressure from a pump driven by the internal combustion engine.

5. The apparatus of claim 3 further including first annular sealing means positioned around the circumference of said first pressure receiving head to prevent the fluid from passing from said fluid pressure port into said exhaust port.

6. The apparatus of claim 5 further including second annular sealing means positioned around the circumference of said second pressure receiving head to prevent the pressurized air received by said air pressure port from flowing to said control port when said piston is in the first position.

7. The apparatus of claim 6 further including a third annular sealing means positioned around the circumference of said third pressure receiving head to prevent pressurized air from said air pressure port from flowing to said exhaust port when said piston is in the second position.

8. The apparatus of claim 7 wherein the diameter of said second pressure receiving head is equal to the diameter of said third pressure receiving head.

9. The apparatus of claim 8 wherein the diameter of said first pressure receiving head exceeds the diameter of said second and said third pressure receiving heads.

10. The apparatus of claim 9 wherein:

a. said first annular sealing means includes an annular groove in said first pressure receiving head having an O-ring therein slidably engaging said bore;

b. said second annular sealing means includes an annular groove in said second pressure receiving head having an O-ring therein slidably engaging said bore; and c. said third annular sealing means includes an annular groove in said third pressure receiving head having an O-ring therein slidably engaging said bore.

* * * * *